United States Patent [19]

Desrochers

[11] Patent Number: 4,768,127

[45] Date of Patent: Aug. 30, 1988

[54] IGNITION SYSTEM

[75] Inventor: Louis-Georges Desrochers, Longueuil, Canada

[73] Assignee: C-I-L Inc., North York, Canada

[21] Appl. No.: 104,295

[22] Filed: Oct. 5, 1987

Related U.S. Application Data

[63] Continuation of Ser. No. 865,354, May 21, 1986, abandoned.

[51] Int. Cl.[4] ..... F23Q 7/00

[52] U.S. Cl. ..... 361/251; 102/218

[58] Field of Search ..... 361/248, 251; 102/206, 102/218

[56] References Cited

U.S. PATENT DOCUMENTS

| | | | |
|---|---|---|---|
| 4,106,073 | 8/1978 | Hedberg | 361/248 |
| 4,297,947 | 11/1981 | Jones et al. | 361/248 |
| 4,422,379 | 12/1983 | Geller et al. | 102/206 |

*Primary Examiner*—L. T. Hix
*Assistant Examiner*—David M. Gray
*Attorney, Agent, or Firm*—Donald G. Ballantyne

[57] ABSTRACT

A plurality of electric blasting caps are fired through the ignition system which includes a transformer having a primary winding and a secondary winding. The secondary winding of the transformer is connected to the resistive elements of the blasting caps through a blasting circuit which is electromagnetically coupled to the resistive elements of the blasting caps via a small toroid transformer. A D.C. voltage is stored on a storage capacitor which has one end connected to the center point of the primary winding. The other ends of each half of the primary winding are connected through a driver circuit to ground. Each driver circuit is enabled by a flip-flop at predetermined intervals, whereby the storage capacitor will discharge through the appropriate half of the primary, to thereby produce a pulse train at the output of the secondary. The pulse train provides the ignition power for igniting the electric blasting caps.

4 Claims, 2 Drawing Sheets

IGNITION SYSTEM

This a continuation of application Ser. No. 06/865,354 filed May 21, 1986 now abandoned.

BACKGROUND OF INVENTION

1. Field of the Invention

The invention relates to an ignition system for firing electric blasting caps. More specifically, the invention relates to such an ignition system which can simultaneously ignite more blasting caps than presently available ignition systems.

2. Description of Prior Art

An ignition system which employs electromagnetic coupling between the energy source and the ignition element in the cap is taught in, for example, U.S. Pat. No. 4,297,947, Jones et al, Nov. 3, 1981. Although the patented system has proven to be very effective, it is limited as to the number of caps it can ignite simultaneously.

SUMMARY OF INVENTION

It is an object of the invention to provide an ignition system which overcomes the limitations of the prior art.

It is a more specific object of the invention to provide such an ignition system which can ignite more blasting caps simultaneously than can presently available ignition systems.

In accordance with the invention, there is provided, in an ignition system for firing a plurality of electric blasting caps, which ignition system includes a transformer having a primary winding and a secondary winding and means connecting the secondary winding to the resistive elements of the blasting caps, a means for storing a D.C. voltage. The means for storing is connected to the primary winding. The means for storing is discharged through the primary at predetermined intervals whereby a pulse train is produced in the primary winding. The pulse train is transmitted through the secondary winding to the resistive elements.

BRIEF DESCRIPTION OF DRAWINGS

The invention will be better understood by an examination of the following description, together with the accompanying drawings, in which.

DESCRIPTION OF PREFERRED EMBODIMENTS

Figure 1:
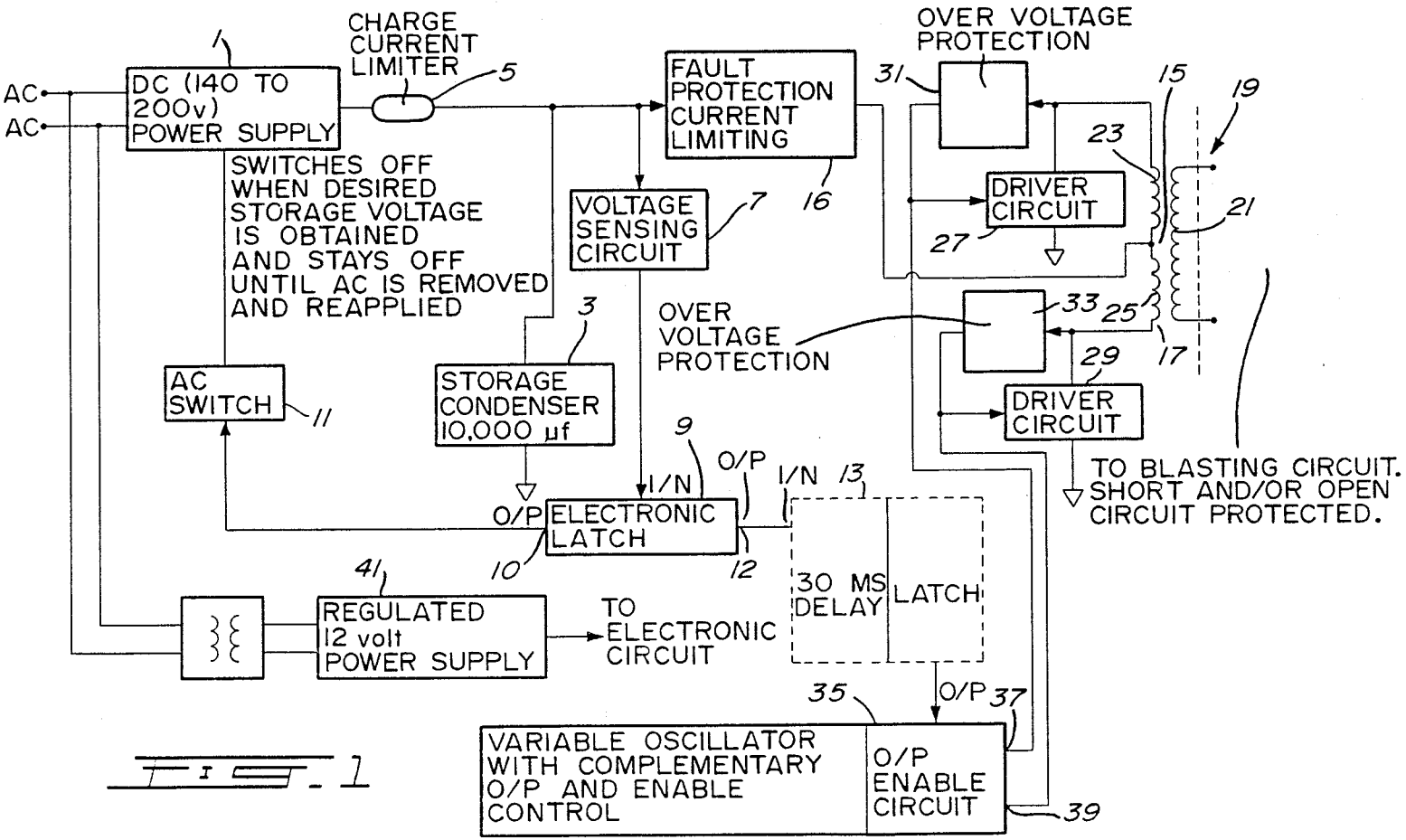
FIG. 1 is a schematic drawing of the inventive system.

Referring to FIG. 1, the system includes a high voltage D.C. power supply 1. Basically, the power supply is nothing more than a circuit including rectifiers and the like for converting an A.C. input, from the A.C. mains, to a D.C. output. Such circuits are well known in the art and require no further description.

The output of the D.C. power supply 1 is fed to a means for storing charge, for example, a storage capacitor, illustrated at 3, through a charge current limiter 5 which, as is well known in the art, can comprise a resistor. One end of the storage capacitor 3 is connected to the output of the D.C. power supply, and the other end is connected to a point of common potential, e.g., ground. The one end of the storage capacitor is also connected to the input of a voltage sensing circuit 7. The purpose of the voltage sensing circuit is to determine when the voltage across the storage capacitor reaches a predetermined level. Such circuits are well known in the art.

The output of the voltage sensing circuit is fed to the input of an electronic latch 9 which has outputs 10 and 12. Output 10 of the electronic latch 9 is fed to an input of A.C. switch 11, and the output of A.C. switch 11 is fed to the ON/OFF terminal of the D.C. power supply 1. The other output, 12, of electronic latch 9, is fed to a delay latch means 13, as will be further discussed below.

The one end of the storage capacitor 3 is also fed to the mid-point 15 of primary winding 17 of transformer 19 which has a secondary winding 21. The one end of storage capacitor 3 is fed to the mid-point 15 through a fault protection current limiting device 16 which, once again, can comprise a resistor.

The primary winding 17 consists of a first half 23, which extends from the mid-point 15 in one direction, and a second half 25, which extends from the center point 15 in the opposite direction. The half 23 is in circuit with a driver circuit 27, while the half 25 is in circuit with a driver circuit 29. Driver circuits 27 and 29 will be more fully described in association with FIG. 2 below.

Over voltage protection means 31 is in circuit with the driver circuit 27 while over voltage protection means 33 is in circuit with the driver circuit 29 and over voltage protection means 34 is between the gates and the grounded terminals of the FETs. The over voltage protection means comprise arrangements of zener diodes to limit the voltage as well known in the art.

The output of delay latch means 13 is fed to an ON/-OFF terminal of a flip-flop arrangement 35 which has outputs 37 and 39. As well known in the art, when the output 37 is high, then output 39 is low and vice versa.

All of the electronic circuits, such as the voltage sensing circuit 7, the electronic latch 9, the delay latch means 13, the driver circuits 27 and 29 and the over voltage protection means 31 and 33 are powered by a bias voltage supply 41 which is also connected to the A.C. mains.

Figure 2:
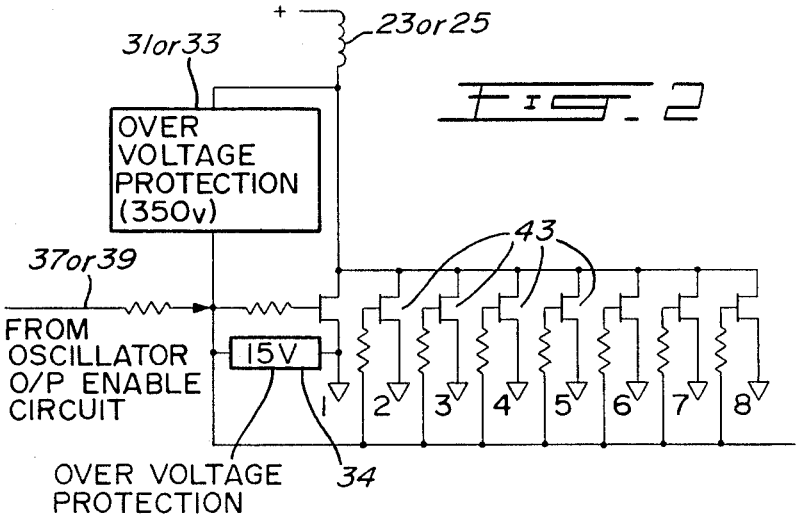
FIG. 2 illustrates in greater detail the driver circuit in FIG. 1.

Turning now to FIG. 2, the driver circuits 27 and 29 comprise a plurality of switches arranged in parallel. Specifically, in a preferred embodiment, they comprise eight (8) power FETS 43 in parallel arrangement. Output 37 is connected to the gates of the FETS of driver circuit 27, while output 39 is connected to the gates of the FETS of driver circuit 29.

Figure 5:
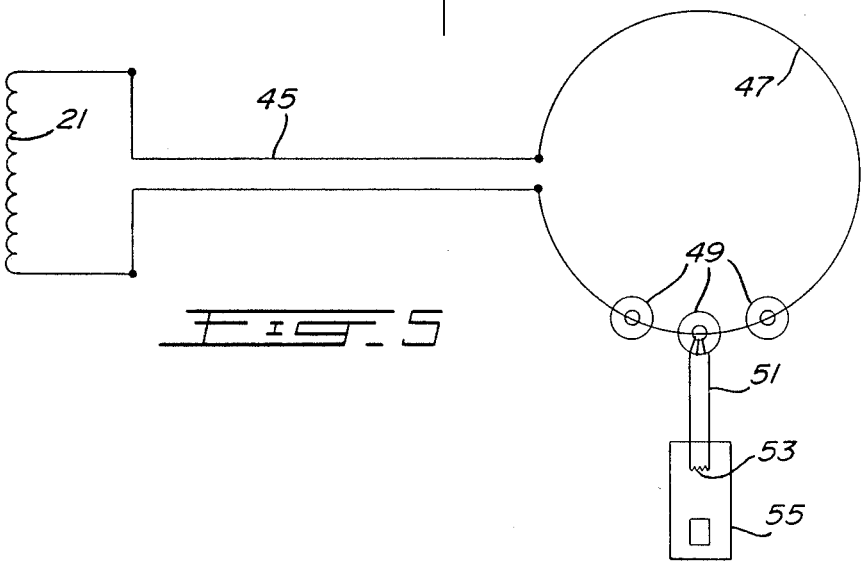
FIG. 5 illustrates how the system of FIG. 1 is connected to blasting caps.

Turning now to FIG. 5, the secondary 21 of the transformer 19 is connected to a lead cable 45 which can be from 300 to 1,000 feet in length of 10 to 12 gauge wire. The lead cable 45 is in turn connected to either end of a primary loop 47. The loop 47, which is 100–300 ft. long, is threaded through a plurality of Toroids 49 (up to 300), and the secondary 51 of each Toroid is connected to the resistive element 53 of a respective blasting cap 55. The latter arrangement is similar to the arrangement illustrated in FIG. 2 of the '947 patent above referred to.

In operation, the system works as follows:

After the blasting caps have been placed and the Toroids have been threaded, the plug of the D.C.

power supply is plugged into the mains, and the A.C. of the mains is converted to D.C. voltage which charges the storage capacitor 3. When the charge on the storage capacitor causes a predetermined voltage to appear across the capacitor (in a preferred embodiment 140 volts), then the voltage sensing circuit will emit a signal to trip the electronic latch 9. The electronic latch will in turn, through its output 10, provide a signal to actuate the A.C. switch 11 which, in turn, will turn off the D.C. power supply. The A.C. switch 11 will remain activated until the A.C. source is disconnected from the system.

At the same time, the electronic latch will provide, through its output 12, a signal to trip delay latch means 13. The delay latch means will provide a predetermined delay (preferably 30 ms), whereupon the delay latch means 13 will, in turn, provide an activating signal to the flip-flop arrangement 35. The flip-flop arrangement will then be turned on to provide signals alternately at its output 37 and 39. The frequency of the flip-flop is preferably made variable. In one arrangement, the frequency of the flip-flop is 10 kHz.

Turning now to FIG. 2, when output 37 is high, the voltage will be applied to the FETs 43 of driver circuit 27 to turn ON all of these FETs. Thus, there will be provided a path for discharging storage capacitor 3 through half 23 and through the short circuited FETs 43 of driver circuit 27. On the other half of the flip-flop cycle, the output 39 is high and a discharge path for the storage capacitor is provided through the half 25 and the driver circuit 29. Each of the driver circuits as is clearly shown in FIGS. 1 and 2 has an output connected to common potential, e.g., ground.

Figure 3:
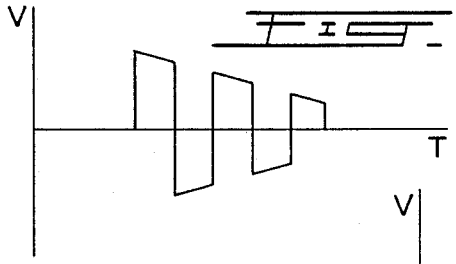
FIG. 3 shows the signal at the primary of the transformer in FIG. 1.
Figure 4:
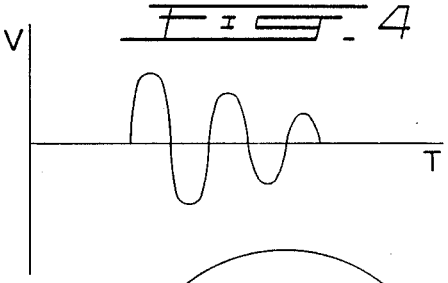
FIG. 4 shows the signal at the secondary of the transformer in FIG. 1.

The signal at the center point 15 of the primary 17 is, thus, a pulse train of decreasing amplitude as illustrated in FIG. 3. This signal, being an A.C. signal, is transformed and the signal, as illustrated in FIG. 4, appears across the secondary 21 of the transformer 19. Preferably, the transformation ratio of the transformer 19 is of the order of 6–8:1. Thus, the output of the secondary is of the order of 950 volts "peak", 6 amps average. This output is applied, simultaneously, to each resistive element 53 of the blasting caps 55 connected to the primary loop 47 through the Toroids 49.

In view of the fact that 8 FETs are used in parallel, it is not necessary to use any high power switch. The entire arrangement permits the delivery of sufficient energy to fire up to 300 detonators.

In addition, most prior art systems which employ electro magnetic coupling between the source of energy and the blasting caps require a capacitor circuit with the secondary to cancel part of the inductance of the blasting circuit. In the present arrangement, because of the level of energy delivered, such a capacitor is not required. Accordingly, the output is steadier in that it is not affected by unexpected resonance in the output circuit which unexpected resonance could lead to high voltages or currents.

Although a particular embodiment has been described, this was for the purpose of illustrating, but not limiting, the invention. Various modifications, which will come readily to the mind of one skilled in the art, are within the scope of the invention as defined in the appended claims.

We claim:

1. In an ignition system for firing a plurality of electromagnetically-coupled electric blasting caps, said ignition system comprising in combination a transformer having a primary winding and a secondary winding, and means connecting said secondary winding to the resistive elements of said blasting caps;

a storage capacitor for storing a D.C. voltage and including means for charging said storage capacitor to a predetermined voltage level; and means for permitting discharge of said storage capacitor at predetermined intervals through said primary winding, said discharge means comprising driver circuit means comprising a parallel arrangement of a plurality of electronic switch means, and means for activitating the electronic switch means at said predetermined intervals whereby to produce a pulse train in said primary winding which is transmitted, through said secondary winding to said resistive elements to thereby fire said blasting caps;

the primary winding having a center jpoint, a first half of said primary winding extending from said center point at one end of said first half in one direction to the other end of said first half, a second half of said primary winding extending from said center point at the other end of said second half in the opposite direction to the other end of said second half;

one end of said storage capacitor being connected to said center point and the other end of said storage capacitor being connected to a point of common potential;

said driver circuit means comprising a first driver circuit and a second driver circuit;

said first driver circuit being connected between the other end of siad first half and said point of common potential;

said second driver circuit being connected between the other end of said second half and said point of common potential, each of the said first and second driver circuits comprising at least eight field effect transistors (FETs) connected in parallel arrangement;

said means for activating said switch means being connected to the gate terminals of all of said FETs, the said means for activating comprising a flip-flop having a first output and a second output, said first output being connected to the gate terminals of said FETs of said first driver circuit, and said second output being connected to the gate terminals of said FETs of said second driver circuit;

the said means for charging said storage capacitor to said predetermined level comprising:

a D.C. power supply having an output connected to said one end of said storage capacitor, and also having an ON/OFF terminal;

a voltage sensing circuit having an input connected to said one end of said capacitor and also having an output;

a first latch means having an input connected to the output of said voltage sensing circuit and also having a first and a second output;

switch means having an input connected to the first output of said first latch means and also having an output connected to the ON/OFF terminal of said D.C. power supply;

whereby, said D.C. power supply charges said storage capacitor to increase the D.C. level of said storage capacitor and, when said D.C. level reaches said predetermined level, said first latch means is tripped to activate said switch means to turn off said power supply.

2. A system as defined in claim 1 wherein said first latch means also has a second output, and further comprising:

a delay latch means for providing a predetermined delay and having an input connected to the second output of said first latch means, and also hainvg an output;

said flip-flop having an ON/OFF terminal connected to the output of said delay latch means;

whereby said flip-flop is turned ON after passage of said predetermined delay following the time when said predetermined level is reached on said storage capacitor.

3. A system as defined in claim 2 and further including first current limiting means connected between the output of said D.C. power supply at said one end of said storage capacitor; and second current limiting means connected between said one end of said storage capacitor and said center point of said primary winding.

4. A system as defined in claim 3 and further including first over voltage protection means for said first driver circuit connected between the gates of said FETs and one other terminal of said FETs, and second over voltage protection means for said second driver circuit connected between the gates of said FETs and the other terminal of said FETs.

* * * * *